US006874828B2

(12) United States Patent
Roatis et al.

(10) Patent No.: US 6,874,828 B2
(45) **Date of Patent: *Apr. 5, 2005**

(54) BAYONET LOCKING SYSTEM FOR VENDING MACHINES AND THE LIKE

(75) Inventors: Calin Vasile Roatis, DesPlaines, IL (US); William D. Denison, Palos Hills, IL (US); Tomasz Barnas, Lake in the Hills, IL (US); Gary L. Myers, Monee, IL (US)

(73) Assignee: TriTeq Lock and Security, L.L.C., Elk Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/345,864

(22) Filed: Jan. 16, 2003

(65) Prior Publication Data

US 2003/0137152 A1 Jul. 24, 2003

Related U.S. Application Data

(63) Continuation of application No. 09/962,508, filed on Sep. 25, 2001.

(60) Provisional application No. 60/252,210, filed on Nov. 21, 2000.

(51) Int. Cl.[7] ..... E05C 3/06; E05C 1/06

(52) U.S. Cl. ..... 292/199; 292/201; 292/144; 70/208

(58) Field of Search ..... 292/199, 201, 292/99, 112, 160, 144, 142, DIG. 25, DIG. 49, 336.3, 251; 70/208, 280, 281, 282, 278.7, 279.1, 257; 220/200, 203.04, 211, 212.5, DIG. 17

(56) References Cited

U.S. PATENT DOCUMENTS 1,875,768 A 9/1932 Smith
1,907,625 A 5/1933 Vogt (Continued)

FOREIGN PATENT DOCUMENTS

JP 02-91371 3/1990

*Primary Examiner*—Robert J. Sandy
*Assistant Examiner*—André L. Jackson
(74) *Attorney, Agent, or Firm*—Leydig, Voit & Mayer Ltd.

(57) ABSTRACT

A bayonet locking system for vending machines is provided to lock and unlock the machine preferably with a remotely controlled electronic operating unit. It includes at least one motor driven axially and rotationally movable bayonet with an enlarged shaped head being mounted preferably on a gasketed door and at least one receptacle receiving device disposed within the machine interior positioned for engagement by the bayonet when the door is moved to an intermediate position. The bayonet advances into the receptacle and rotates to capture it in the receptacle and then axially retracts to pull the door into the closed position wherein a gasket disposed between the door and the machine is substantially uniformly compressed and sealed around its periphery. An axially rotatable pin with fins may be used with a bracket on either the door or machine to prevent prying of the door at opposite corners.

18 Claims, 16 Drawing Sheets

U.S. PATENT DOCUMENTS

| | | | | |
|---|---|---|---|---|
| 2,269,264 | A | | 1/1942 | Haim |
| 2,877,637 | A | | 3/1959 | Greenwald |
| 3,080,633 | A | | 3/1963 | Reddy |
| 3,089,330 | A | | 5/1963 | Kerr |
| 3,550,412 | A | | 12/1970 | Pitel et al. |
| 4,159,138 | A | | 6/1979 | Smith |
| 4,167,104 | A | | 9/1979 | Bond |
| 4,213,230 | A | | 7/1980 | Hoen |
| 4,300,664 | A | | 11/1981 | Helm et al. |
| 4,355,830 | A | | 10/1982 | Rau, III |
| 4,411,544 | A | | 10/1983 | Gallman |
| 4,552,001 | A | | 11/1985 | Roop |
| 4,556,244 | A | | 12/1985 | Bisbing |
| 4,583,775 | A | | 4/1986 | Bisbing |
| 4,671,547 | A | | 6/1987 | Weinerman et al. |
| 4,744,392 | A | | 5/1988 | Tade et al. |
| 4,760,721 | A | | 8/1988 | Steinbach |
| 4,899,561 | A | | 2/1990 | Myers |
| 4,993,247 | A | | 2/1991 | Minemura |
| 5,106,251 | A | | 4/1992 | Steinbach |
| 5,160,180 | A | | 11/1992 | Mlynarczyk |
| 5,269,161 | A | | 12/1993 | Stillwagon |
| 5,272,894 | A | | 12/1993 | Stillwagon et al. |
| 5,349,345 | A | | 9/1994 | Vanderschel |
| 5,467,619 | A | | 11/1995 | Stillwagon et al. |
| 5,548,982 | A | | 8/1996 | Rawling |
| 5,618,082 | A | | 4/1997 | Jachmich |
| 5,813,257 | A | | 9/1998 | Claghorn et al. |
| 5,921,119 | A | | 7/1999 | Myers et al. |
| 6,068,305 | A | | 5/2000 | Myers et al. |
| 6,106,035 | A | * | 8/2000 | Hetherington ..... 292/251 |
| 6,345,522 | B1 | | 2/2002 | Stillwagon et al. |
| 6,360,573 | B1 | | 3/2002 | Ming-Chih |
| 6,370,928 | B1 | | 4/2002 | Chies et al. |
| 6,374,649 | B1 | | 4/2002 | Holcomb et al. |
| 6,406,071 | B1 | | 6/2002 | LaViola et al. |
| 6,575,504 | B2 | * | 6/2003 | Roatis et al. ..... 292/199 |
| 6,581,986 | B2 | * | 6/2003 | Roatis et al. ..... 292/199 |

* cited by examiner

BAYONET LOCKING SYSTEM FOR VENDING MACHINES AND THE LIKE

CROSS-REFERENCE TO RELATED PATENT APPLICATIONS

This application is a continuation of U.S. application Ser. No. 09/962,508, filed Sep. 25, 2001, and is based on Disclosure Document No. 453,811, filed Mar. 26, 1999, entitled "Vending Bayonet Lock" and claims priority on U.S. Provisional Patent Application No. 60/252,210, filed Nov. 21, 2000

FIELD OF THE INVENTION

The present invention relates generally to locking devices and, more particularly, to a bayonet locking system for vending machines and the like and a method for locking and unlocking the same.

BACKGROUND OF THE INVENTION

In various machines such as vending machines, food machines, candy machines, refrigerated drink machines, and the like, there is ordinarily provided a lock assembly to prevent unauthorized access to the contents thereof. For example, some vending machines are provided with a key-activated lock assembly such as a pop-out T-handle lock assembly which allows an authorized user to open the door of the vending machine with a properly-encoded key. Such T-handle lock assemblies are well known in the art, as evidenced by numerous patents including U.S. Pat. No. 3,089,330 (Kerr), U.S. Pat. No. 3,550,412 (Pitel et al.), U.S. Pat. No. 4,552,001 (Roop), U.S. Pat. No. 4,760,721 (Steibach), U.S. Pat. No. 4,899,561 (Myers), and U.S. Pat. No. 5,548,982 (Rawling). With such lock assemblies, the door is initially closed in a loose manner to catch the locking components of the lock assembly. Next, the handle of the locking assembly is rotated to draw the door against the housing of the vending machine and to compress a seal between the door and the housing. Other, more modern, vending machines are provided with a keypad-activated lock assembly which permits the door of the vending machine to be opened when a predetermined access code or combination is entered into the keypad. The prior art, however, failed to provide a lock assembly which automatically pulls the door of a vending machine into a completely closed position against the housing and/or a lock assembly which utilizes a remotely controlled electronic latching mechanism to lock and unlock the door. More recently, however, as shown in U.S. Pat. No. 6,068,305 (Myers et al.) such a locking system was proposed. Further refinements, improvements and better, different and improved locking components and systems have been sought by users and manufacturers of the machines.

OBJECTS OF THE INVENTION

Accordingly, a general object of the present invention is to provide an improved locking system capable of even being a key-less electronic operated lock for vending machines and the like.

A related object of the present invention is to provide a bayonet locking system and method for locking and unlocking vending machines or the like in a novel and secure manner.

An additional object of the present invention is to provide a bayonet locking system having the foregoing characteristics which is more reliable, durable, economical and convenient to use.

SUMMARY OF THE INVENTION

An Electro-mechanical system having a function that facilitates specialized movements that can be utilized to secure and seal a variety of devices. The sealing action is being defined as a pulling motion of the primary mechanism. The locking action happens by virtue of a localized geometry that interfaces into an another specialized designed receiver device. The receiver device is generally mounted in a stationary manner. The localized geometrically designed element is called a bayonet for the purposes of this abstract. The bayonet design is not intended to be a single geometry element that unto itself is design critical to the operation concept of this mechanism. Alternate methodology may be used to facilitate the securing portion of the mechanism.

The bayonet is designed to operate tangent to the receiver in such a manner as to allow it to interlock into the receiver by allowing the bayonet to have geometry that allows the bayonet to enter into and pass behind it. After this is accomplished an electrical detection device sends a signal to an electrical control device. This device then sends a signal to a motor that in turn rotates a cylindrical device located about the bayonet. This cylindrical device has a unique geometry that interfaces with a central located tube type of device and a tubular type pin. The combined rotation causes the bayonet to first rotate 90 degrees or thereabout. And then begin to wind its way up a spiral ramp located in a pocket of the cylindrical device. This cylindrical device also has two binary electrical devices that are strategically located to detect the relative position of the bayonet for both rotation and sealing (pull). This cylindrical device has a typical gear shape located on it outside diameter. This gears movement is derived from a worm gear interface that is driven by a motor. The motor derives its intelligence form the electrical controller.

A specific intelligence is embedded into the controller that facilitates several fault modes and operational parameter of the electromechanical system. This intelligence may be delineated as relay or software type of logic. The lock controller provides two specific functions.

Access control functions to ascertain the authorized user is accessing the locking device. Several access control methodologies may be utilized such as keypads with specific codes for entry, hand-held transceivers, electronic digital keys, transponders, etc.

Typical access control functions such as keypads, remote controls and electronic keys are taught in Denison U.S. Pat. No. 5,618,082 and Vandershel U.S. Pat. No. 5,349,345. The locking device may utilize any such access control methodology that is appropriate for the application for the operator and the enclosure the lock is mounted to.

Lock motor control functions once the controller has determined the lock is authorized to change from the locked to unlocked state, or, authorized to change from the unlocked to locked state. The components required to accomplish the required motor control operation are the motor drive, bayonet, Receiver, Receiver Sensor, SW1 end of rotation sensor, SW2 30 degree Sensor, over-current sensor, and the CPU based controller.

The cylindrical device has a cover located about the opposite side of the area that causes the pin to wind it way on the ramp. This cover keeps the pin in a proper perpendicular path to the mechanisms securing motion.

The utilization of this device is providing simple easy access to devices that by necessity of application have a gasket or another means of sealing a door or the like. This would be described by what is common known as an automotive door. The door must be accelerated to a speed that can facilitate the compression of the gasket and then secure the door. Much like slamming of a car door. This device provides an alternate method of closing the door and pulling the gasket to a sealed condition. This device is also furthered in its invention by having methodology through electrical monitoring of the bayonet conditions to adjust the pressure on the door gasket or seal. This is accommodated either by electrical position devices or detecting the motor characteristics by the electrical controller. The automotive door is used to only describe the actions, which caused the necessity of this invention. Any device that has a requirement for securing and sealing is a possible application of this device.

Applications: Truck doors, Vending machine doors, Automotive doors, Refrigerator doors, Etc.

The cylindrical device with its associated motor and electrical detection devices are always mounted in a manner that separates them from the receiver unit. To further clarify this explanation consider the following sample concept, a car door has a rotary type securing device that is generally located in the door that secures its via a mechanical interface with a pin that is located in the frame of the vehicle. The cylindrical device would draw a similarity in its function as the rotary type device. The utility of this is to further the security by sealing the door after closing. Recalling that this device in its improvement into the market does not require massive forces to initiate the function of securing the bayonet. This means that the device the system is mounted to would inherently be subject to less stress and wear, thus extending its life.

While there are mechanisms in the public domain that facilitate total system functionality of the specific motion similar to that being described here. One of the unique attributes of this product design is its ability to absorb very high closing impact forces without subjecting the system or the mechanism its mounted to any impact damages. This system has shock absorbing devices located within the tube and positioned on the end of the bayonet. Such is this geometry that it does not deter from the adjustment function as an independent local event in the motion of pulling in. The bayonet in this system also serves to assist with alignment of the device it's attached to. By moving from the closed to the secure positions the bayonet has geometry which considers the perpendicularity into its motion and effectively cams it into the perpendicular position. The other mechanisms in the public domain do not account for the stresses as they are applied in any alternative directions. These mechanisms must be fortified by extensive designs to minimize these effects on the mechanisms used. This system eliminates these requirements.

Also the other commercial systems which have similar motion to securing and sealing do not utilize the unique rotary motion of the bayonet used in this system.

This system replaces many devices in the public domain. Systems such a handles for vending machines. This system is designed to operate within the structure of the device it is securing. Therefore there is not external means by which to attack it. It may operate via an electrical controller that can utilize a variety of communication methods that are commercially available. These include but are not limited to Infrared, Radio frequency, and Switch keylock.

Because this design requires the application of an electrical signal to the motor to activate the system for both securing and opening sequence These activities can be monitored for later data collection. This data collection can be facilitated in many methodologies. This data then can serve the operator or owner for the purposes of detecting what key was used to gain access to the system.

One methodology which is being claimed a unique to this design is the ability to monitor the data through acquisition of the data with the remote initialization device. Typically known as a key, Key FOB of remote control. While this data collection is not primary to the system function. It acts to enhance the product to the market place.

US Reference:

U.S. Pat. No. 6,068,305 Fort Lock

U.S. Pat. No. 4,993,247 Sampo Lock

U.S. Pat. No. 5,272,894 Star Lock

Fort Lock U.S. Pat. No. 6,068,305 shows a type of system that pulls in. The pulling forces are transmitted through a rotor type latch. This system differs in that it uses a local designed bayonet that interfaces with a special receiver unit. Sampo U.S. Pat. No. 4,993,247 cites a slip nut arrangement. And U.S. Pat. No. 5,272,894 Star lock shows a retrofit design that eliminates the lazy action but still require manual input.

DESCRIPTION OF THE DRAWINGS

(FIG. 5). At this time (SW 2) changes state serving as a local detection device. FIG. 1 Item 6*b*.

Between Item 2 and mounting plate Item 5 mounting plate there is a thin plate to allow for a sliding friction plate surface this allows for a lubrication area.

In consideration of the electrical functions of the system the following description applies to the controller utilized. This controller features unique combination of sensing and control that differentiate it from controllers used in the public domain.

DISCUSSION OF THE INVENTION AND PREFERRED EMBODIMENT

Locked to Unlocked:

In controlling the motor to change the state of the lock from locked to unlocked, the controller must first receive a valid access control signal from the operator (via a secure access control input means such as a keypad or hand-held transmitter) and shall proceed to energize the motor in the forward direction. The controller will wait for a position feedback indicator (SW1) which is measured by the controller CPU to determine the lock has landed in the unlocked state. If this sensor is closed, the controller will proceed to break and de-energize the motor. In case the SW1 sensor is failed, the controller uses a motor current feedback signal to detect end of worm gear travel by sensing a stall motor condition and to de-energize the motor. In case both sensors fail, the controller will discontinue operation based on elapsed time.

In the case an over-current signal is received, the controller must determine if this signal is a function of a jammed bayonet with the lock still in the locked state, or if this signal is a function of the worm gear reaching the unlocked state and the SW1 sensor failed. In the case of a jam, the receiver sensor is expected to be closed and the condition is still locked. Thus, the controller will proceed to assume a locked condition. In the case the receiver sensor is open, it as assumed that the bayonet has unseated from the receiver and the lock is unlocked. Thus, the controller will proceed to the unlocked state.

Figure 1:
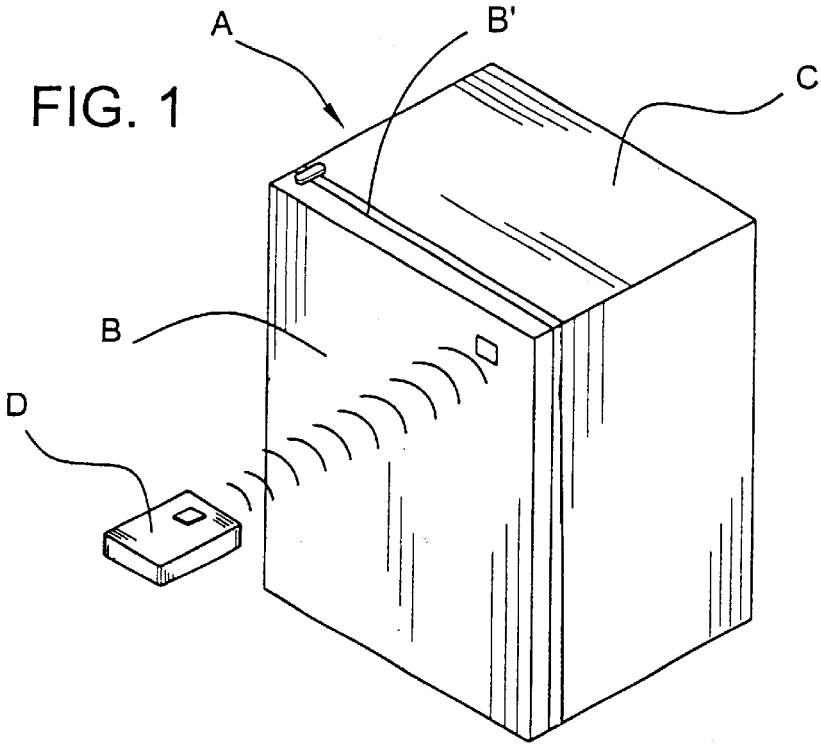
FIG. 1 is a perspective view of an illustrative vending type machine A with a door B, gasket $B^1$ and cabinet C in a closed position and showing a remote controller D.
Figure 2:
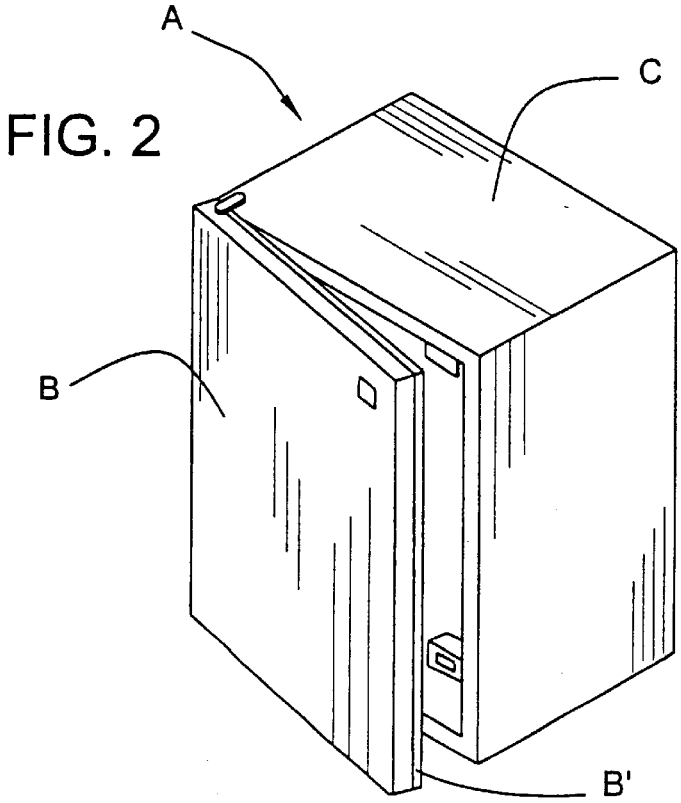
FIG. 2 is a perspective view of the machine of FIG. 1 with the door opened partially.
Figure 3:
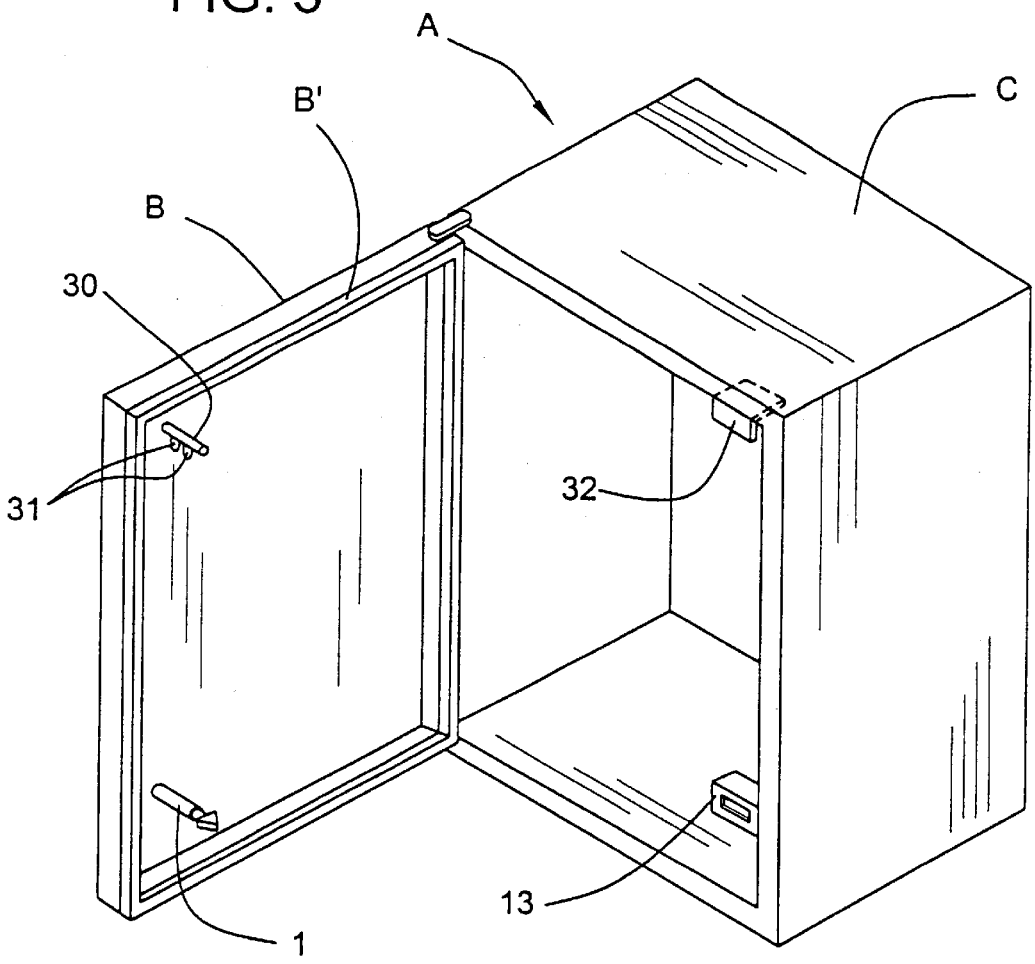
FIG. 3 is a perspective view of the machine of FIGS. 1 and 2 with the door opened and showing the locking devices.
Figure 4:
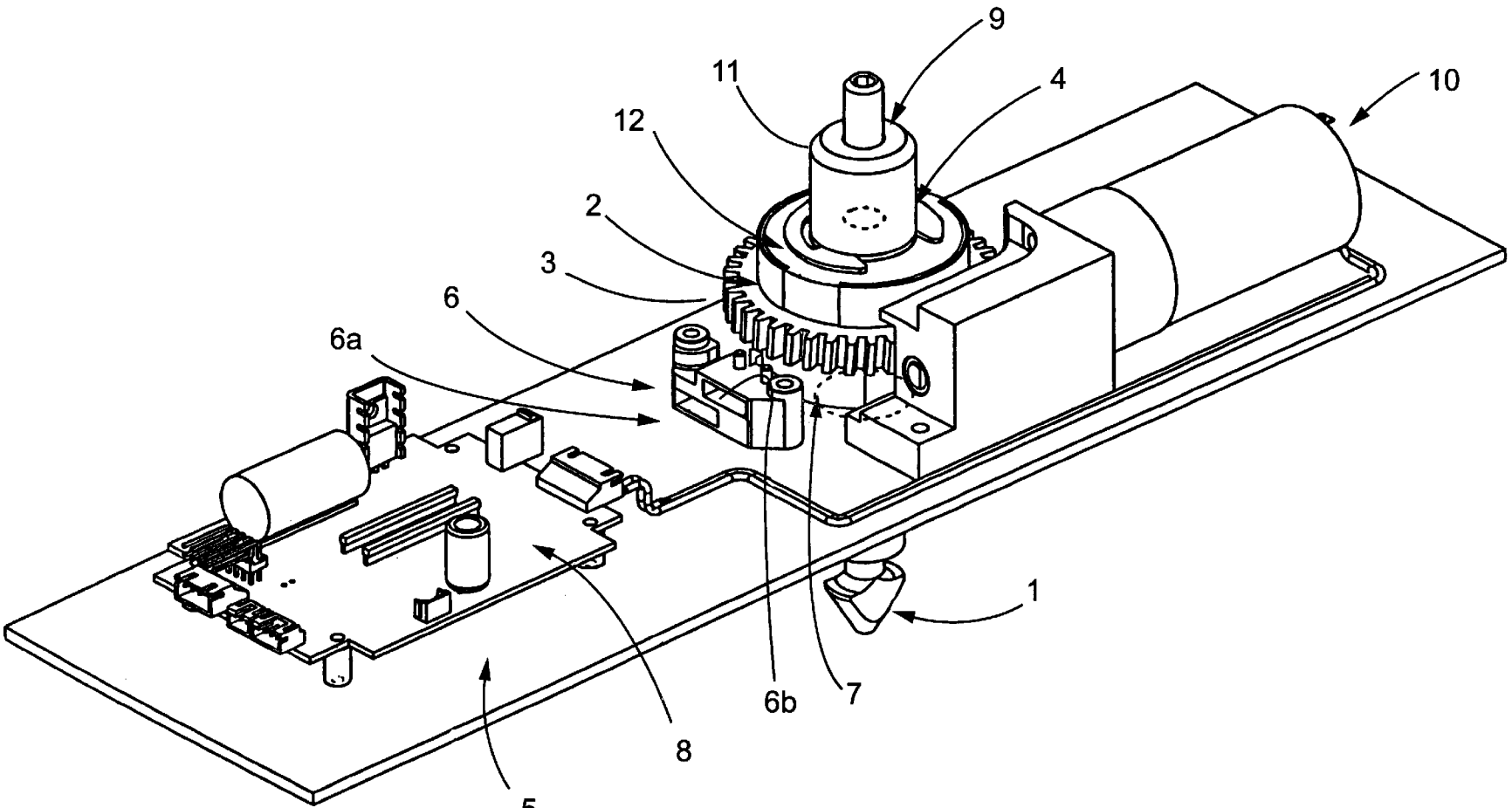
FIG. 4 is a perspective view of the system complete less the receiver unit. Wiring has been deleted to clarify the view. Item 1 is the localized design called a bayonet, its is shown in the secure and pulled in (sealed) position. Item 2 is the cylindrical device with the gear. Item 3 located about its outside diameter. Item 4 is the cover for the cylindrical device. Item 5 is a plate which serves to mount all of the Items. The plate generally is part of the device that is to be secured. Item 6 is the electrical detection mount bracket that houses Items 6*a* (SW 1) and Item 6*b* (SW 2) Item 7 is the local geometry which detects the position of the cylindrical device. Item 8 is the electrical controller board. Item 9 is the adjuster device that positions the bayonet. Item 10 is the motor that provides the drives the gear assembly. Item 11 is the tube. Item 12 is a snap ring that holds the cylindrical device on the tube assembly.
Figure 5:
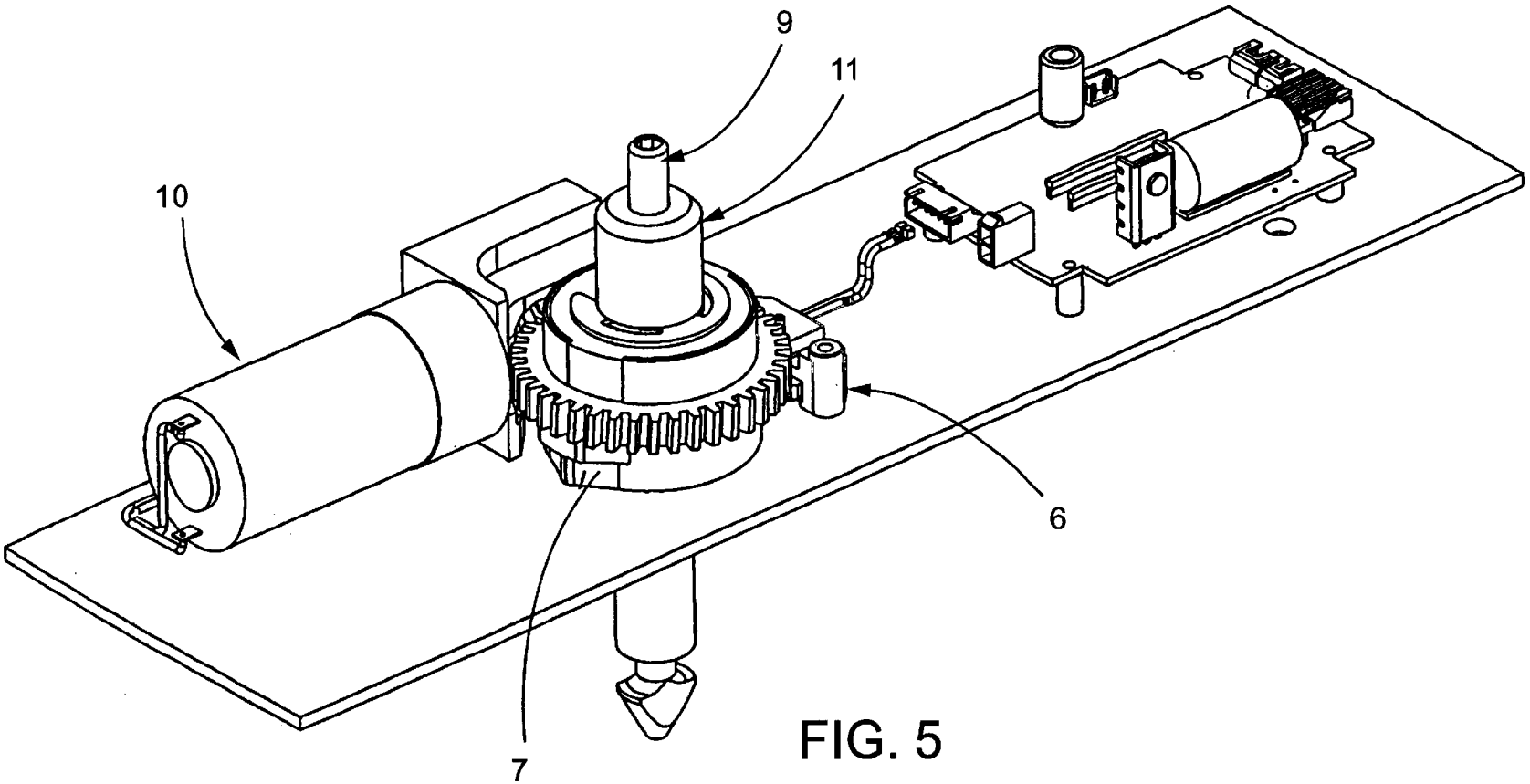
FIG. 5 is a perspective clarifying the position indicators Item 7 of the cylindrical device.
Figure 6:
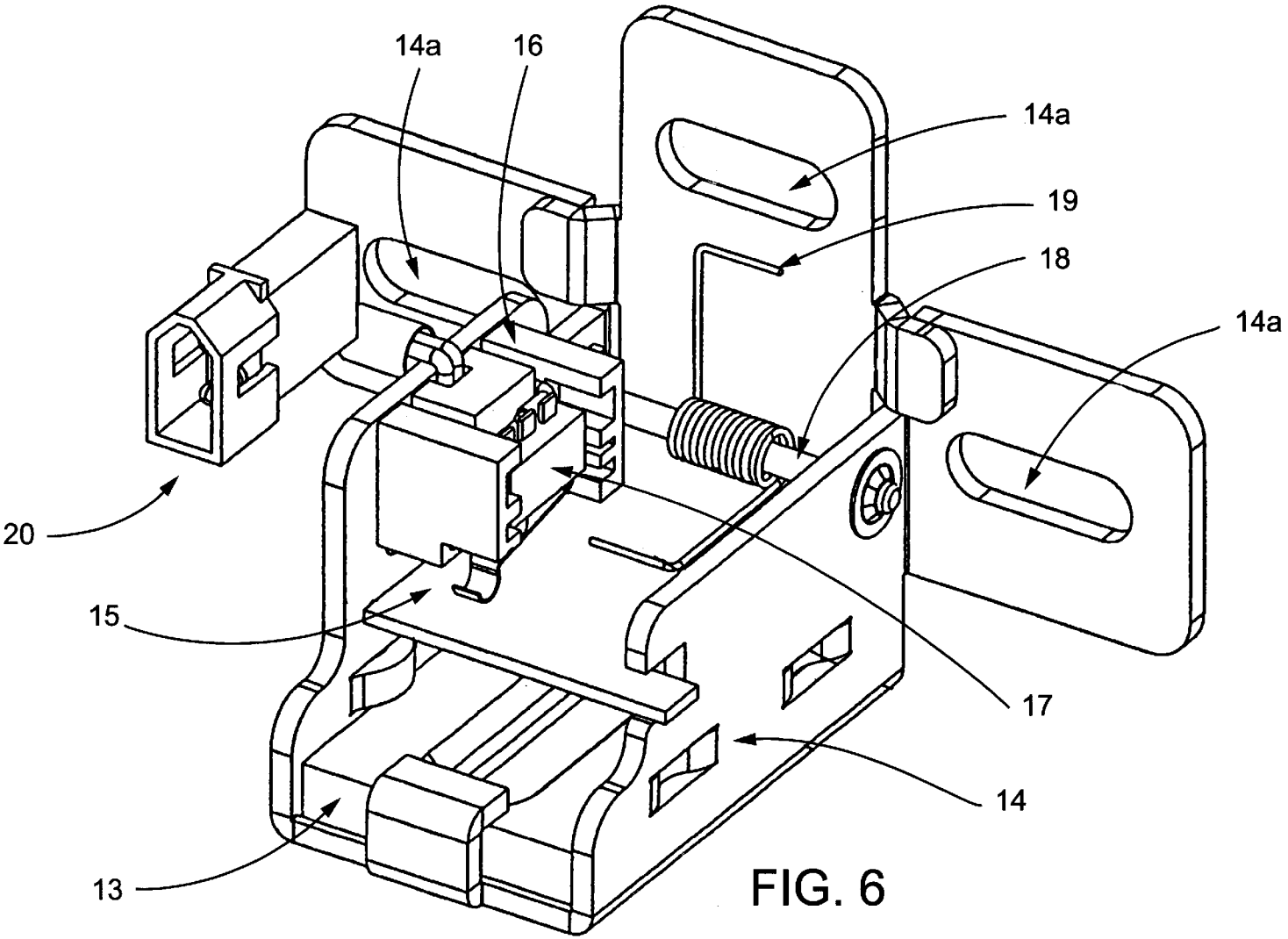
FIG. 6 is a perspective view of the receiver unit. Item 13 is the receiver plate. Item 14 is the housing of the receiver. Item 15 is a door that the bayonet Item 1 pushes as it is inserted into the receiver. Item 17 which is mounted in Item 16 and fasten to Item 14 then switches state. The controller through wiring Item 20 detects this. Items 18 and 19 serve to mount and bias the door assembly. Area Item 14*a* is provided as a typical mounting scenario.
Figure 7:
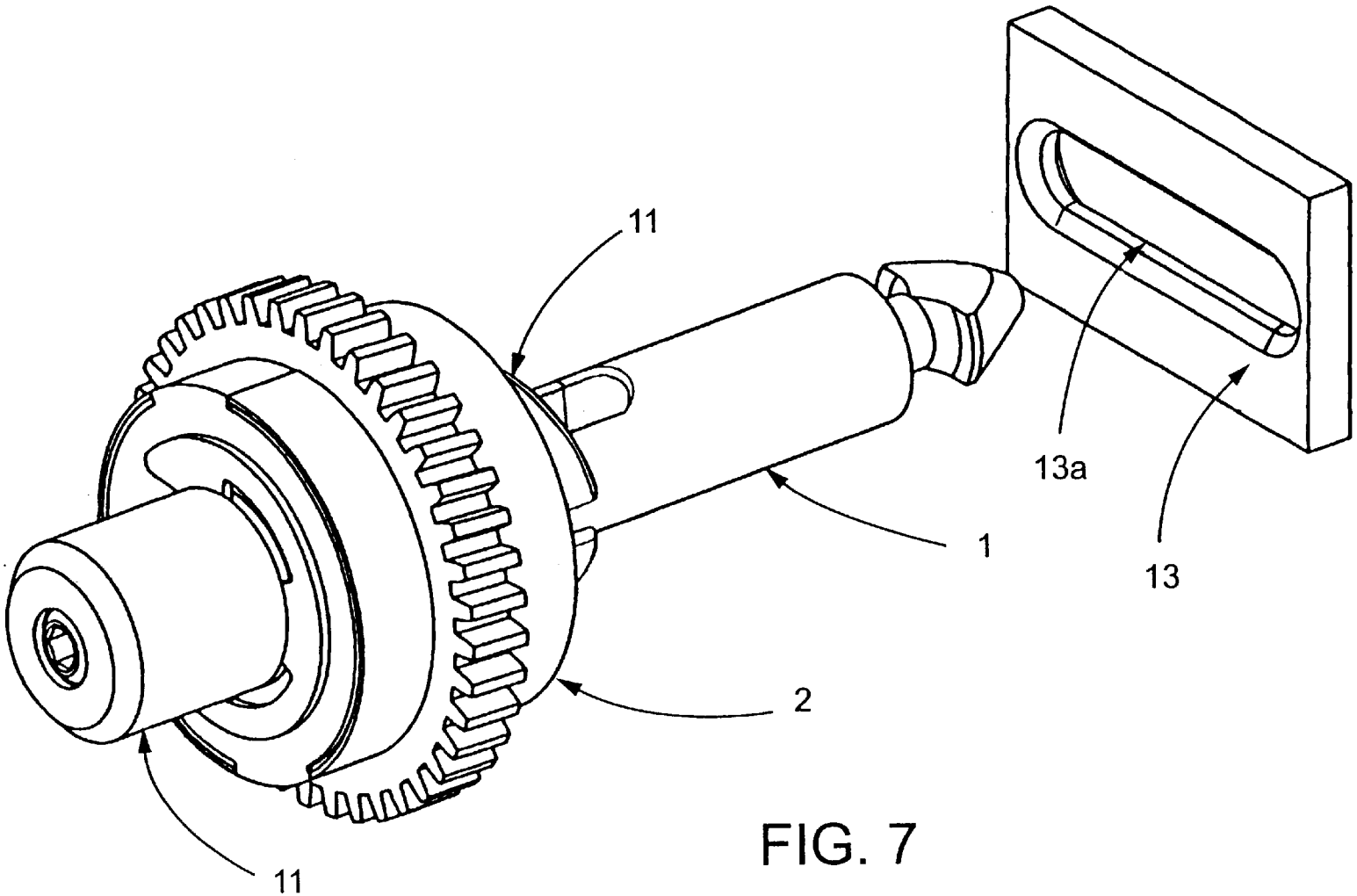
FIGS. 7 and 8 respectively are perspective views of the beginning secure functions. Item 1 is aligned to a slot located in Item 13. Items 11 and 2 move into position (as they are mounted to Item 5) this places the end of the Item 1 behind the Item 13.
Figure 8:
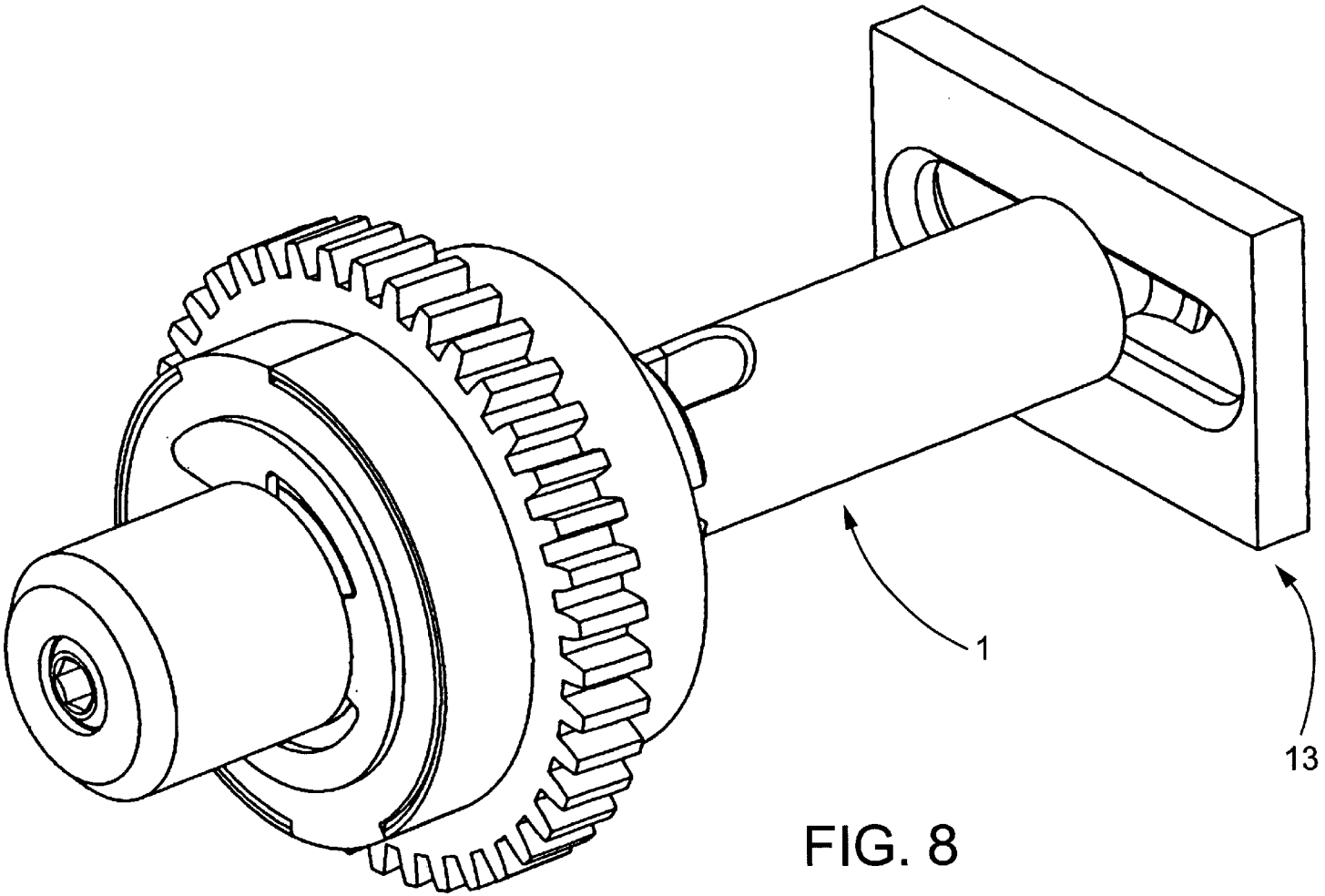
Figure 9:
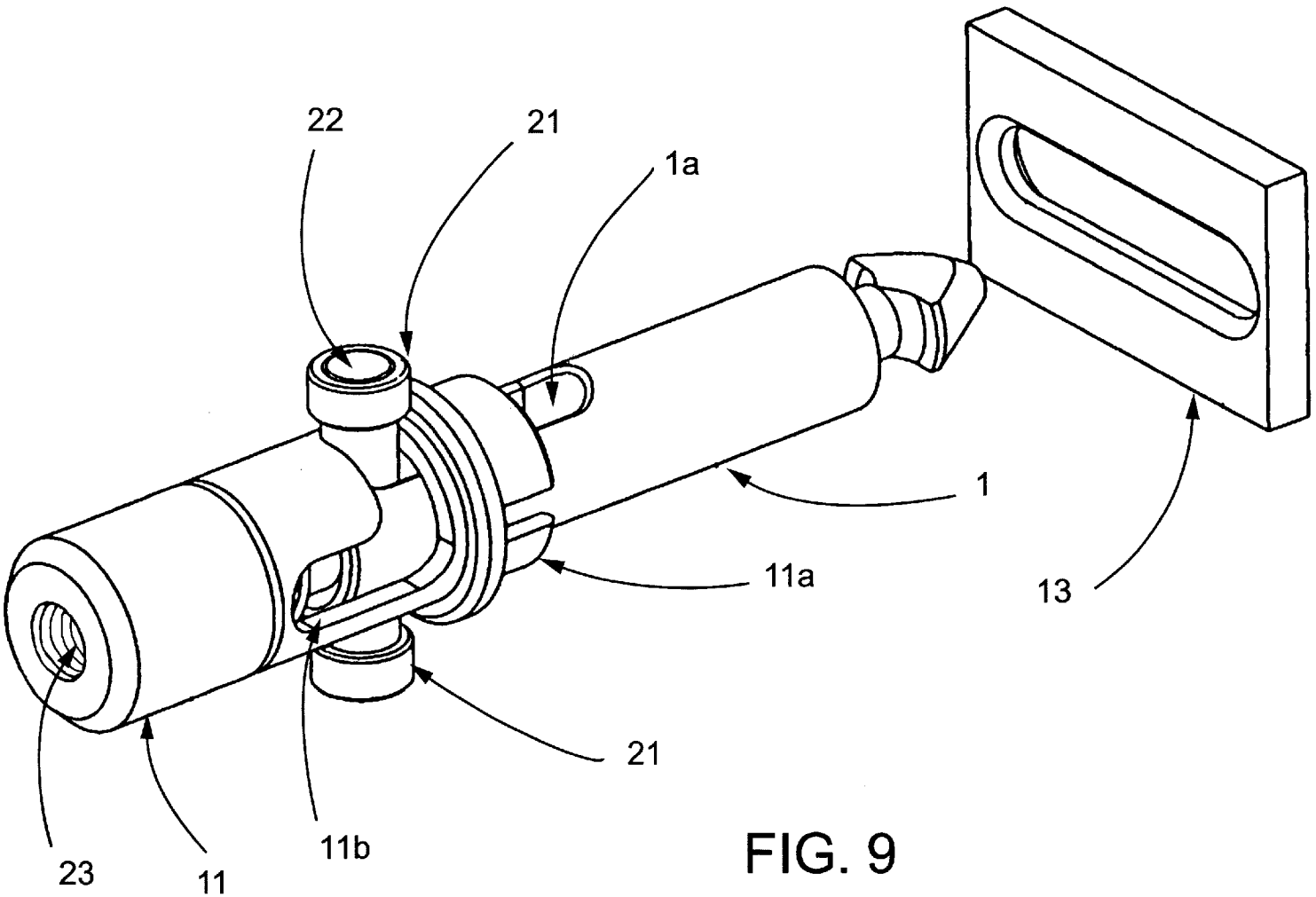
FIG. 9 is a perspective view that has Items 2, 12, and 4 removed. Item 11 is kept stationary via slots located in area 11*a* and with conventional threads. Item 1 has a slot through it to allow a spring action provided by Item 23 as the Item 1 impacts Item 13. The 1*a* slot provides the area for this. The pin Item 22 is held in place by the geometry 11*b*. The rollers Items 21 will provide antifriction surfaces during future operations.
Figure 10:
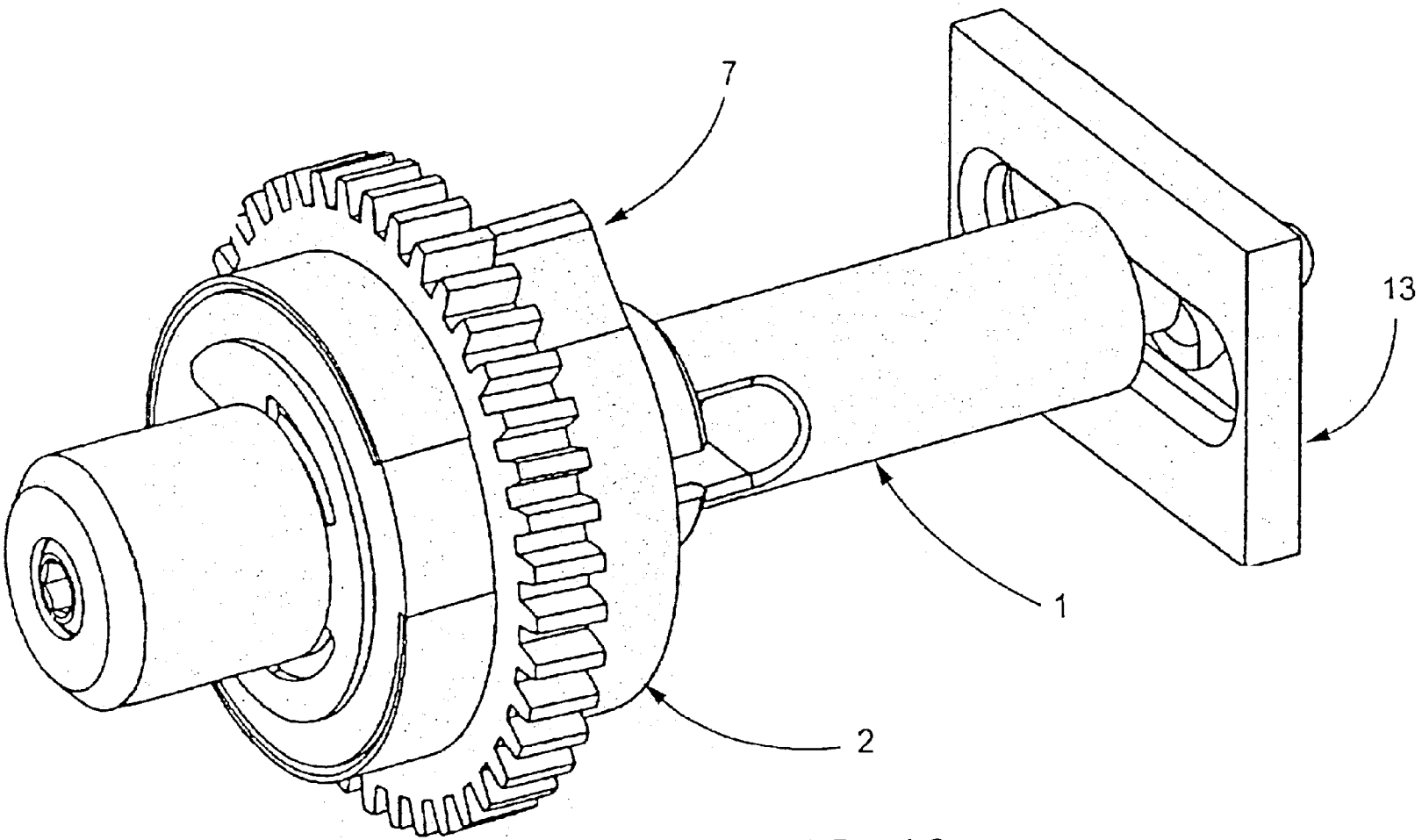
FIG. 10 is a perspective view of the system in its secure position. The Item 2 has rotated and Item 6 FIG. 1 (sw1) has detected the proper position via the Item 7 geometry. Item 1 is now located behind Item 13 and is rotated 90 degrees.
Figure 11:
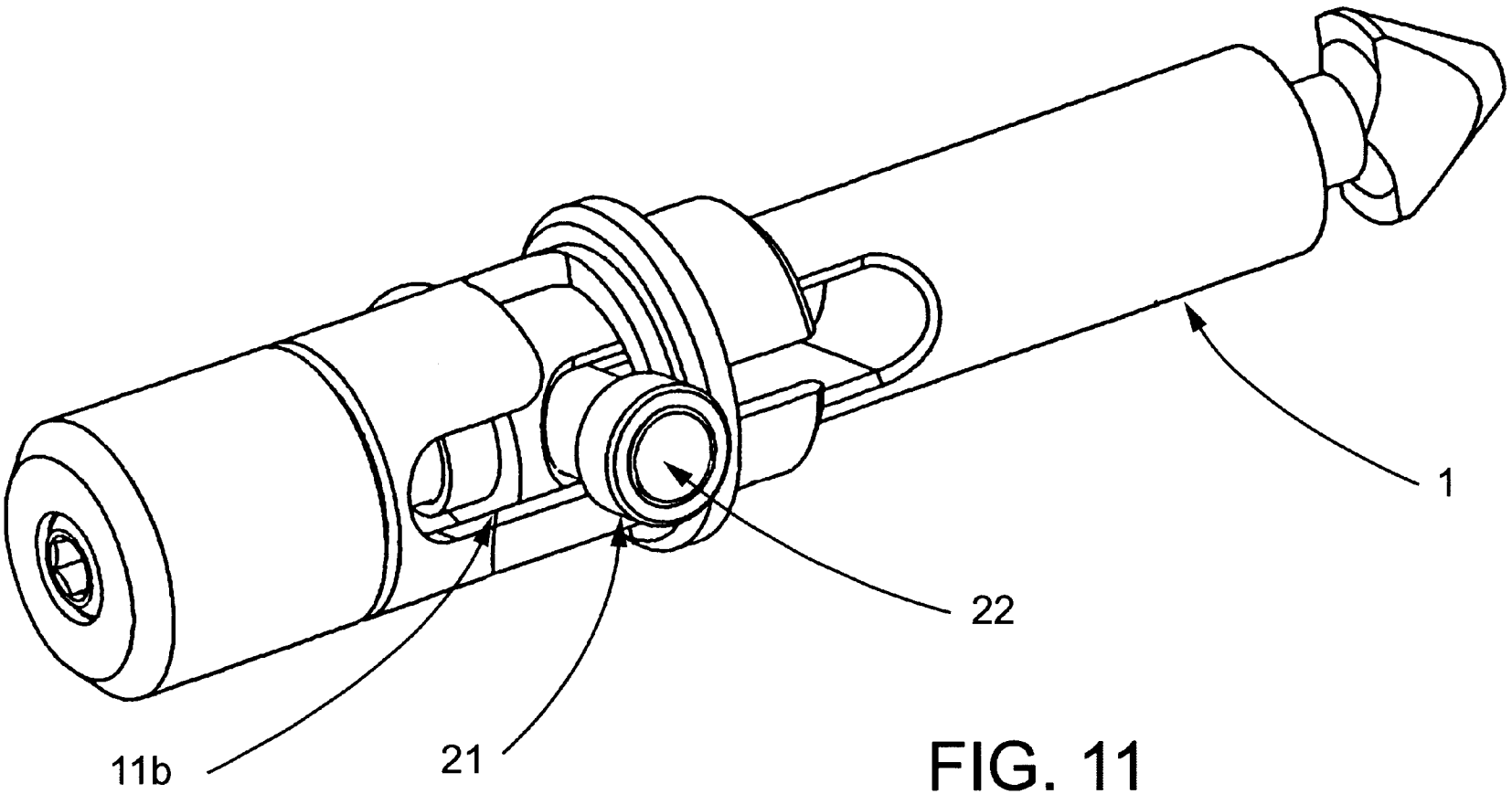
FIG. 11 is a perspective view indicating what the internal geometry is in place at the same time as FIG. 7. Pin Item 22 has moved into position along the 11*b* area. This is accomplished via FIG. 9 area 2*a*. Gear Item 3 rotates about the area 2*e* guided by Item 11. Surface 2*a* causes pin Item 22 to move 90 degrees.
Figure 12:
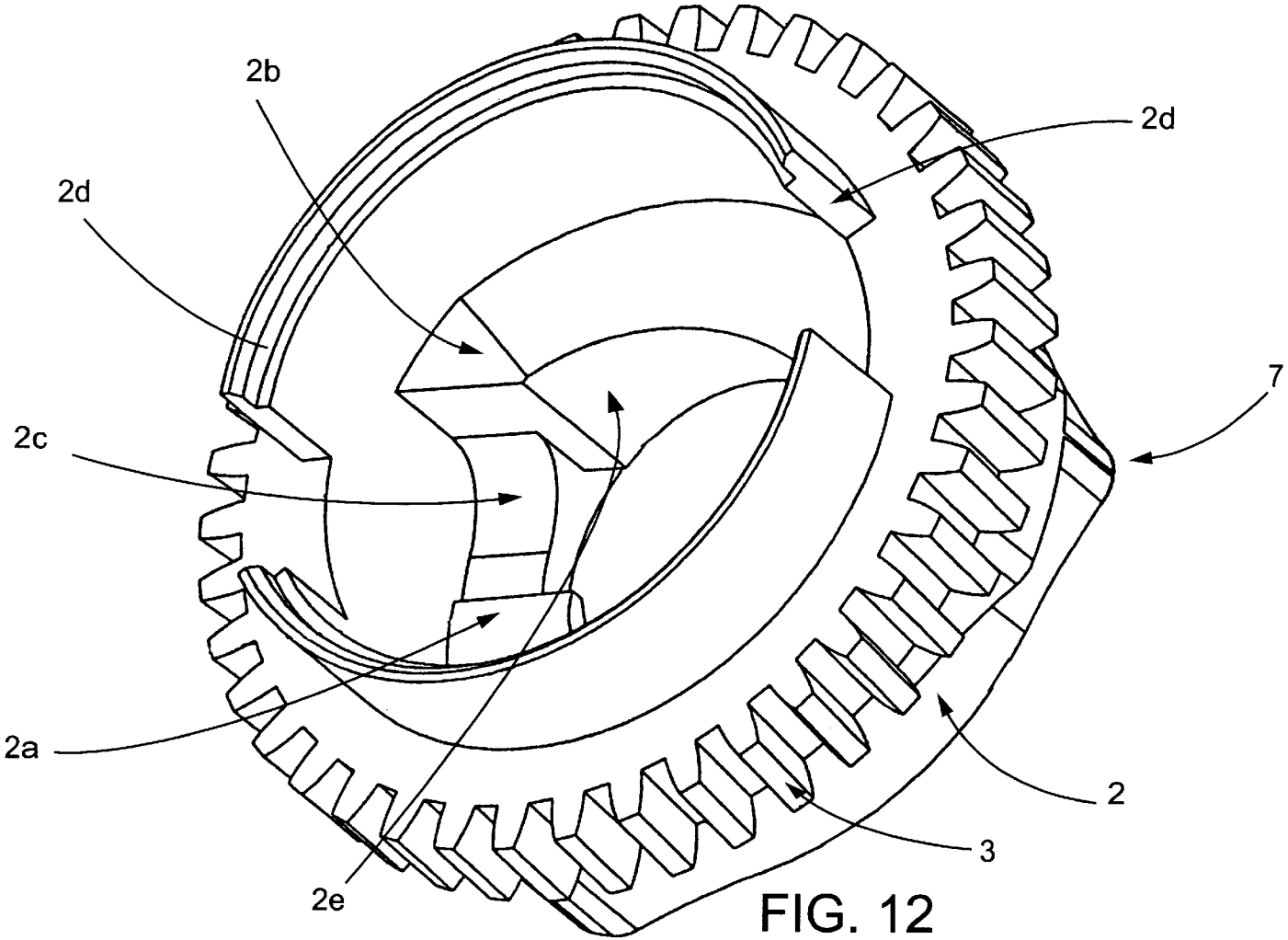
FIG. 12, item 2*d* is provided as mounting surfaces for FIG. 11 Item 4. Surface 4*a* as mounted into Item 2 provide guiding for Items 21 and then translated through to Item 22. Areas Item 4*d* correspond to Item 2*d* FIG. 9 Area 2*a* has a steel reinforced arrangement to prevent deformation of the plastic as it ages.
Figure 13:
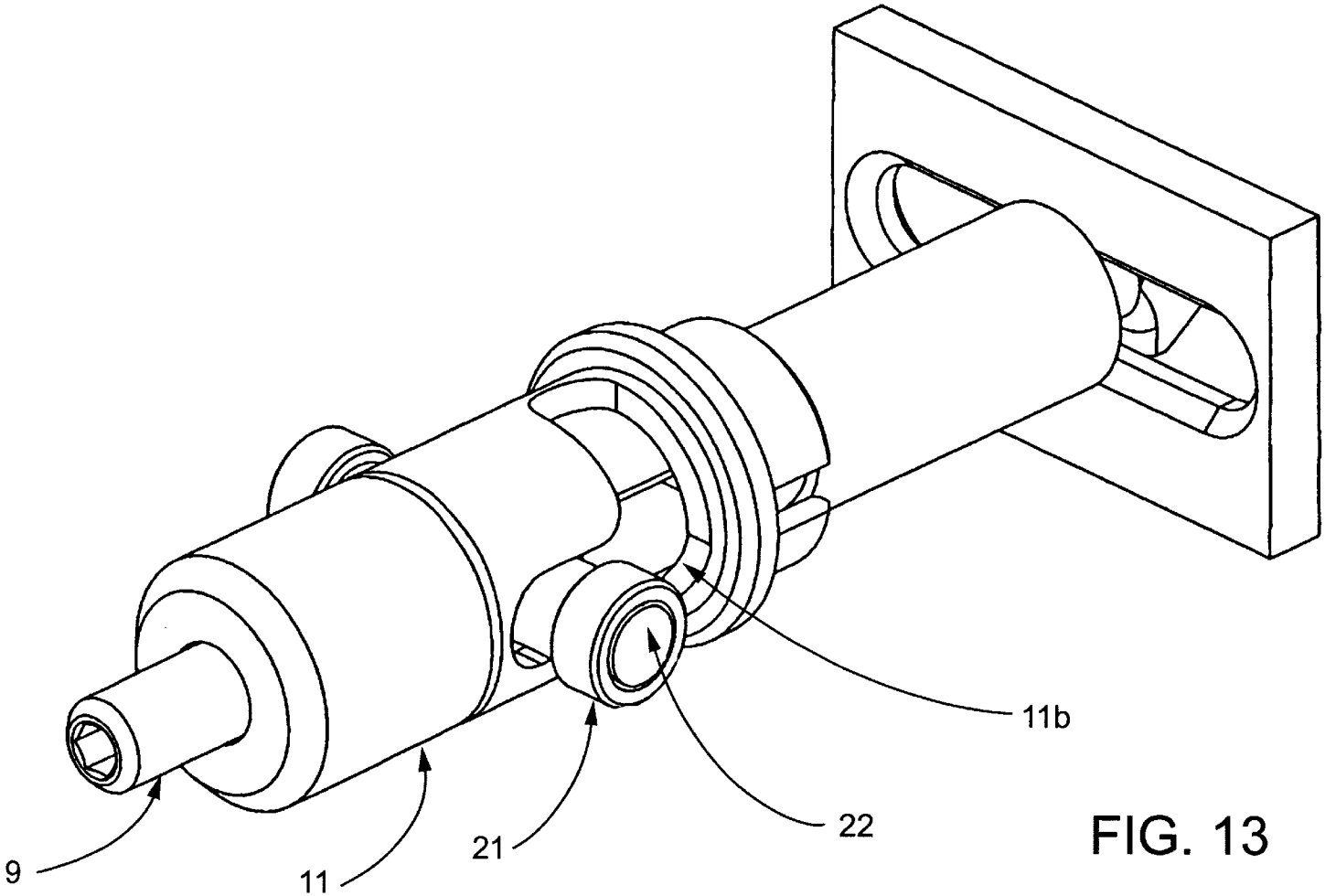
FIG. 13 is a perspective view showing the pulling or sealing function. Item 2 has continued to rotate via the motor Item 10. The local geometry of the ramp area 2*a* through 2*b* causes the rollers Items 21 to move with it. This pulls (moves) the Item 1 back away from Item 13. This is seen by the extension of Item 9 as it protrudes from Item 11.
Figure 14:
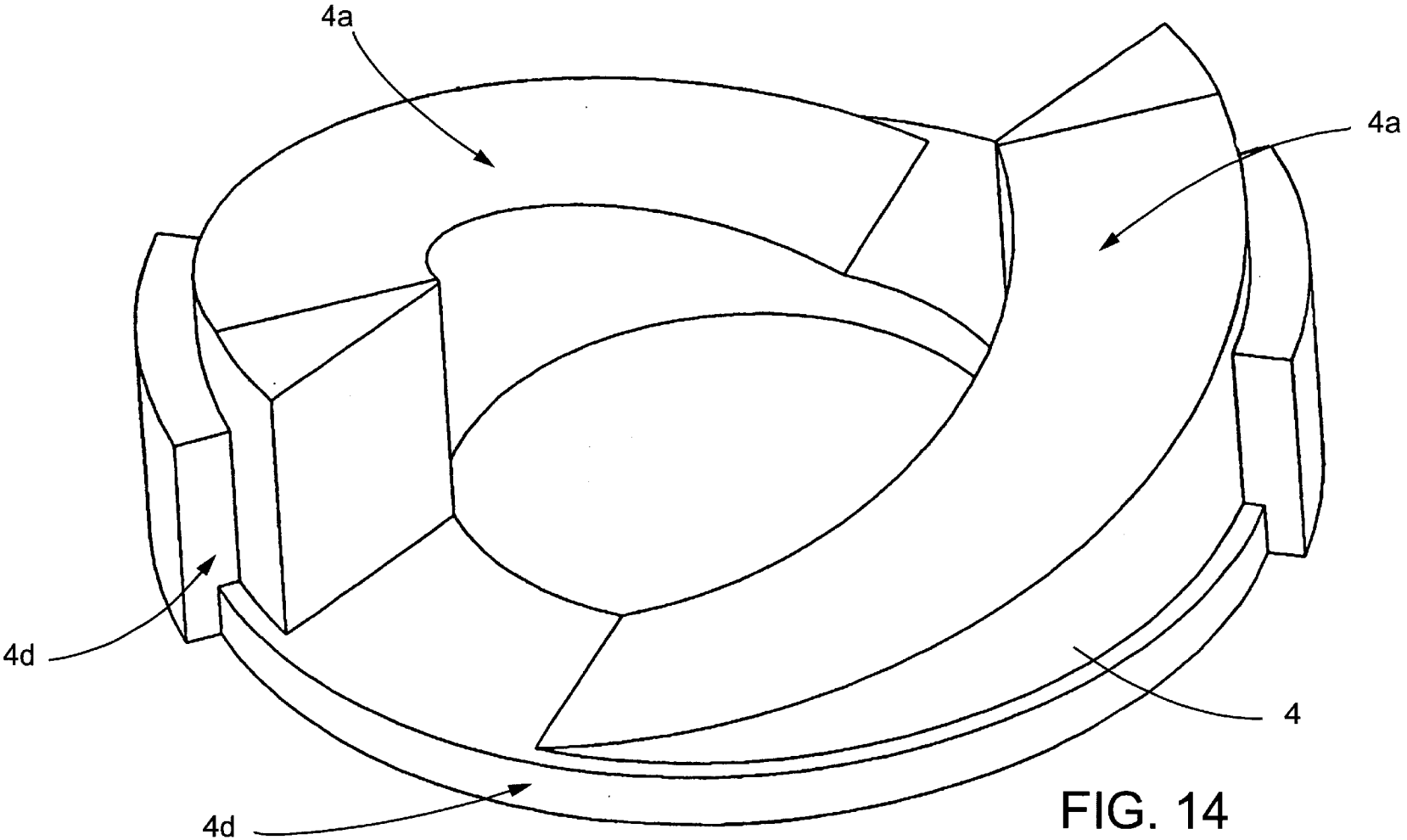
FIG. 14 is a perspective view of the outer guide that mates with the FIG. 9 guide.
Figure 15:
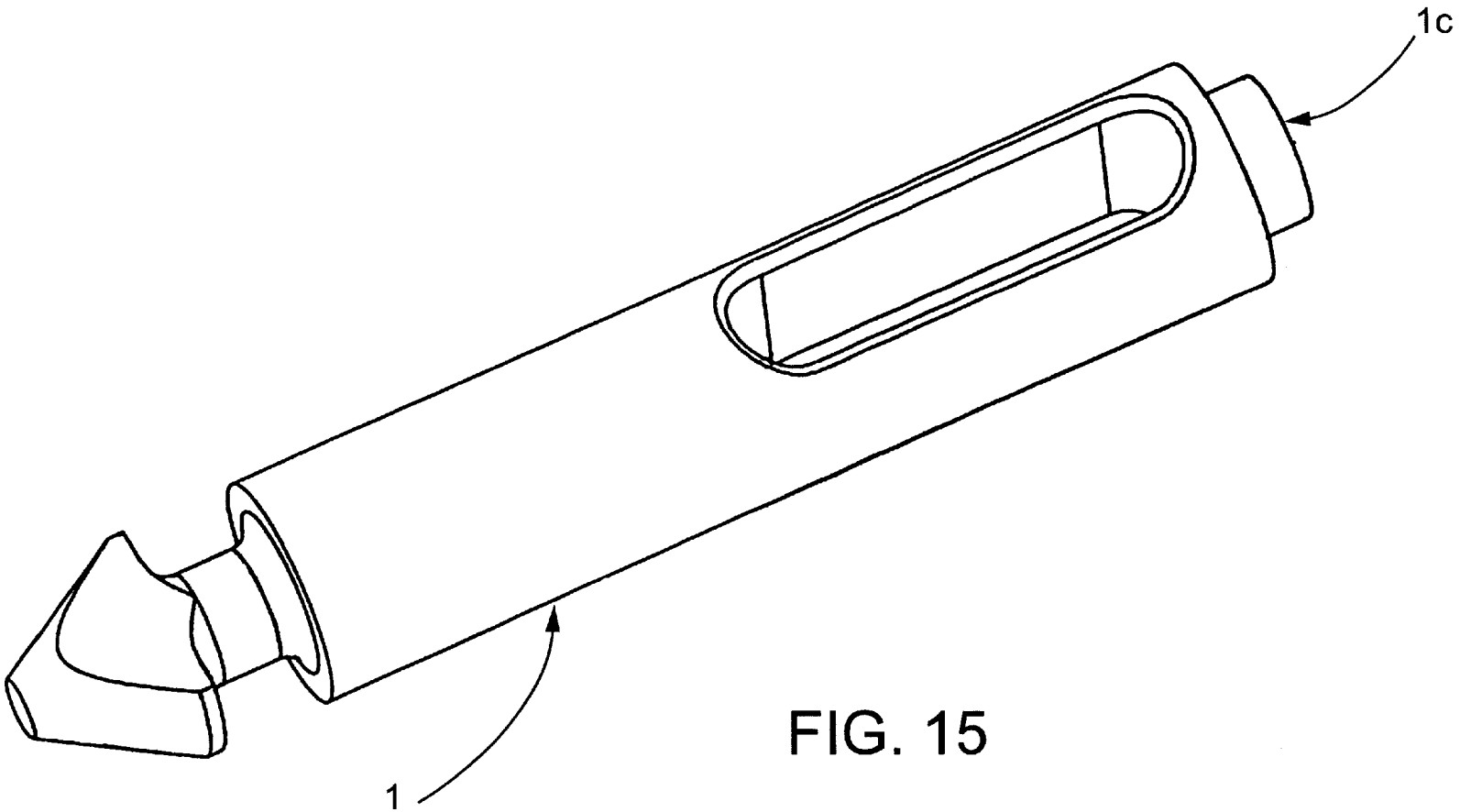
FIG. 15 is a perspective view of the bayonet Item 1. Item 1*c* is threaded to facilitate the adjuster screw Item 9. This screw limits the travel of the Item 1 by intersection of the pin Item 22 with the bottom of the Item 9.

Unlocked to Locked:

In controlling the motor FIG. 4 item 10 to change the state of the lock from unlocked to locked, the controller FIG. 1 Item 8 shall wait to receive a valid lock signal from the operator. This signal shall at a minimum be a sensor signal received by the controller that the bayonet FIG. 4 Item 1 is seated in the receiver As indicated by FIG. 5 (Receiver sensor closed). It is a requirement that the controller must measure the state change of the receiver sensor FIG. 3 Item 17 from open to closed circuit in order to initiate the locking event. In addition to this signal, the controller FIG. 4 Item 8 may also expect to receive a valid access control signal from the operator simultaneously, for example the electronic key. This dual signal requirement would serve the purpose of insuring the operator will not accidentally lock the access control means in the enclosure. The controller FIG. 4 Item 8 shall proceed to energize the motor FIG. 1 Item 10 in the reverse direction. The controller FIG. 4 Item 8 will wait for a position feedback indicator FIG. 4 Item 6*a* (SW 1) which is measured by the controller CPU located on FIG. 4 Item 8 to determine the lock has landed in the secure state. In case the FIG. 1 Item 6*a* (SW 1) sensor is failed, the controller uses a motor current feedback signal to detect end of FIG. 9 area 2*b* end of travel by sensing a stall motor condition and to de-energize the motor. In case both sensors fail, the controller will discontinue operation based on elapsed time.

In addition to the typical locking control operation described above, several safety and fault tolerant monitoring processes must be included in the locking control algorithm. For example, when the controller proceeds to energize the motor, the bayonet will begin to turn and will proceed to be captured behind the stationary receiver device to accomplish the locking feature. At this interface, there can exist a mis-alignment of the bayonet to the receiver FIG. 4 item 13 and the bayonet Item 1 can jam into the receiver surface area FIG. 4 area 13*a*, which would cause a failure of the lock. This failure can be detected by the electronics, which would proceed with a re-initialization process of the lock components (lock bayonet and controller).

The bayonet jam detection will most likely take place during the period the bayonet is rotating to pass behind the receiver. This period is detected by the controller by monitoring a feedback sensor that measures the FIG. 9 Item 2 which relates to the bayonet position, referred to as the FIG. 4 item 6*b* 30 degree sensor SW2. To properly recover from a bayonet jam event during the bayonet rotation period described above, the detection system we chose to implement is a system where the lock motor controller FIG. 4 Item 8 monitors two sensors and controls the lock motor FIG. 4 Item 10 as described below:

The bayonet receiver sensor FIG. 3 Item 17, which is open when the lock is unlocked, would produce a closed signal when the bayonet seats in the receiver to initiate the locking event. Referred to as closed but not secure. If while the FIG. 1 Item 6*b* (SW2) sensor is closed (less than 30 degrees rotation), the receiver later produces an open signal to the controller to indicate the bayonet is no longer properly aligned behind the receiver.

A sensor that measures the current draw of the motor turning the bayonet. If while the FIG. 1 Item 6*b* (SW2) sensor is closed and motor current exceeds a pre-determined value which equals the stall current value of the motor selected for the application, the controller will determine that the bayonet is jammed into the receiver, or, possibly another type of bayonet restriction exists.

The bayonet jam recovery procedure that the controller shall follow is described below:

1. The controller FIG. 1 Item 8 shall proceed to de-energize the motor FIG. 1 Item 10 to stop the bayonet FIG. 1 Item 1 from attempting to turn.

2. The controller shall proceed with a forward energization of the lock motor to return the bayonet to the fully unlocked position. Once the FIG. 1 Item 6*a* (SW 1) sensor is closed and the fully unlocked position FIG. 4 is achieved by the bayonet, the controller will brake the FIG. 1 Item 10 motor and the controller FIG. 1 Item 8 will return to the unlocked operation mode. In this mode, the controller FIG. 1 Item 8 will wait for a locking initiation signal from the operator via a state change from open to closed by the receiver sensor. FIG. 3 Item 17.

Figure 16:
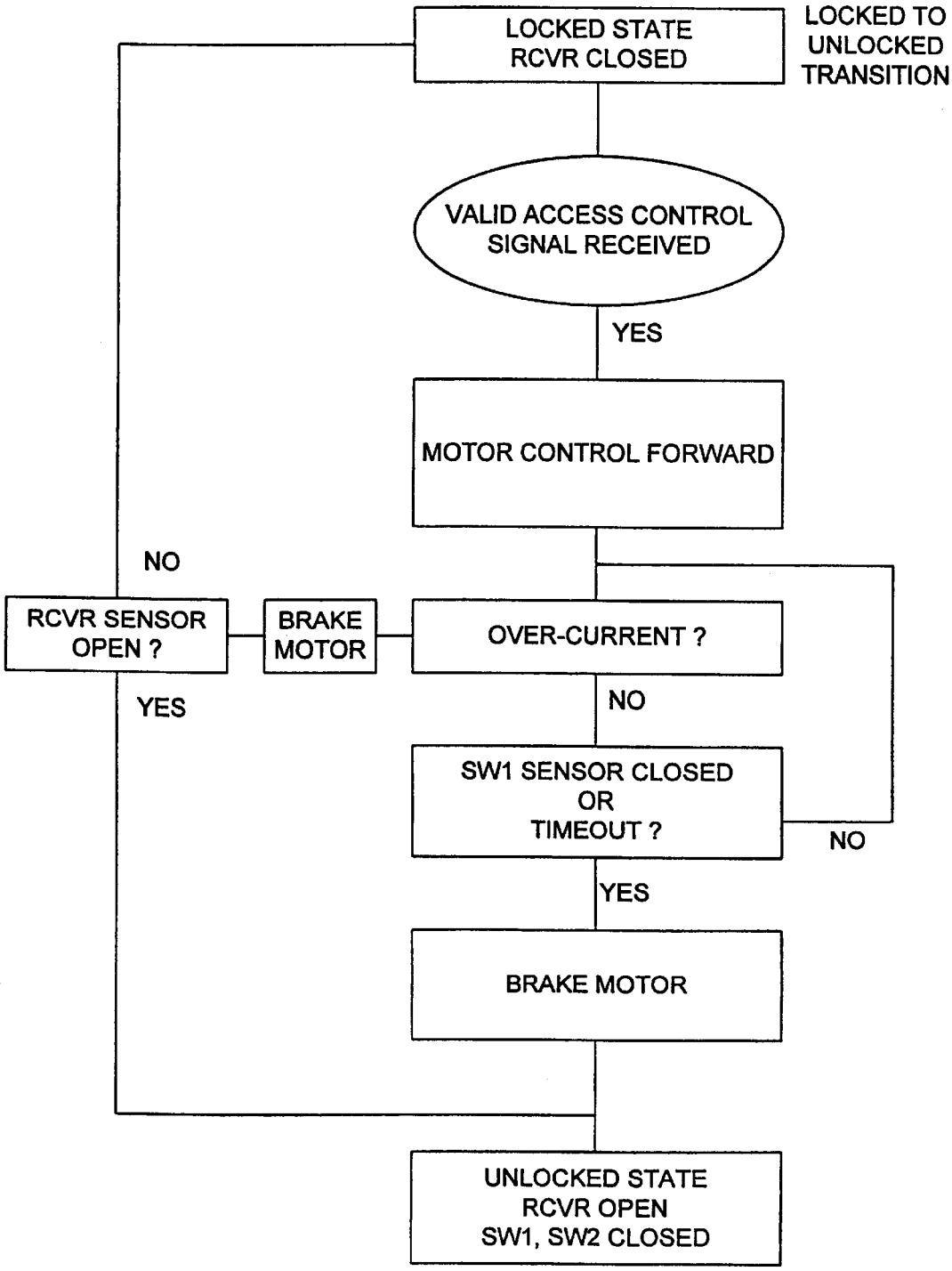
FIGS. 16 and 17 are flow charts showing the respective lock and unlock sequences of operation.
Figure 17:
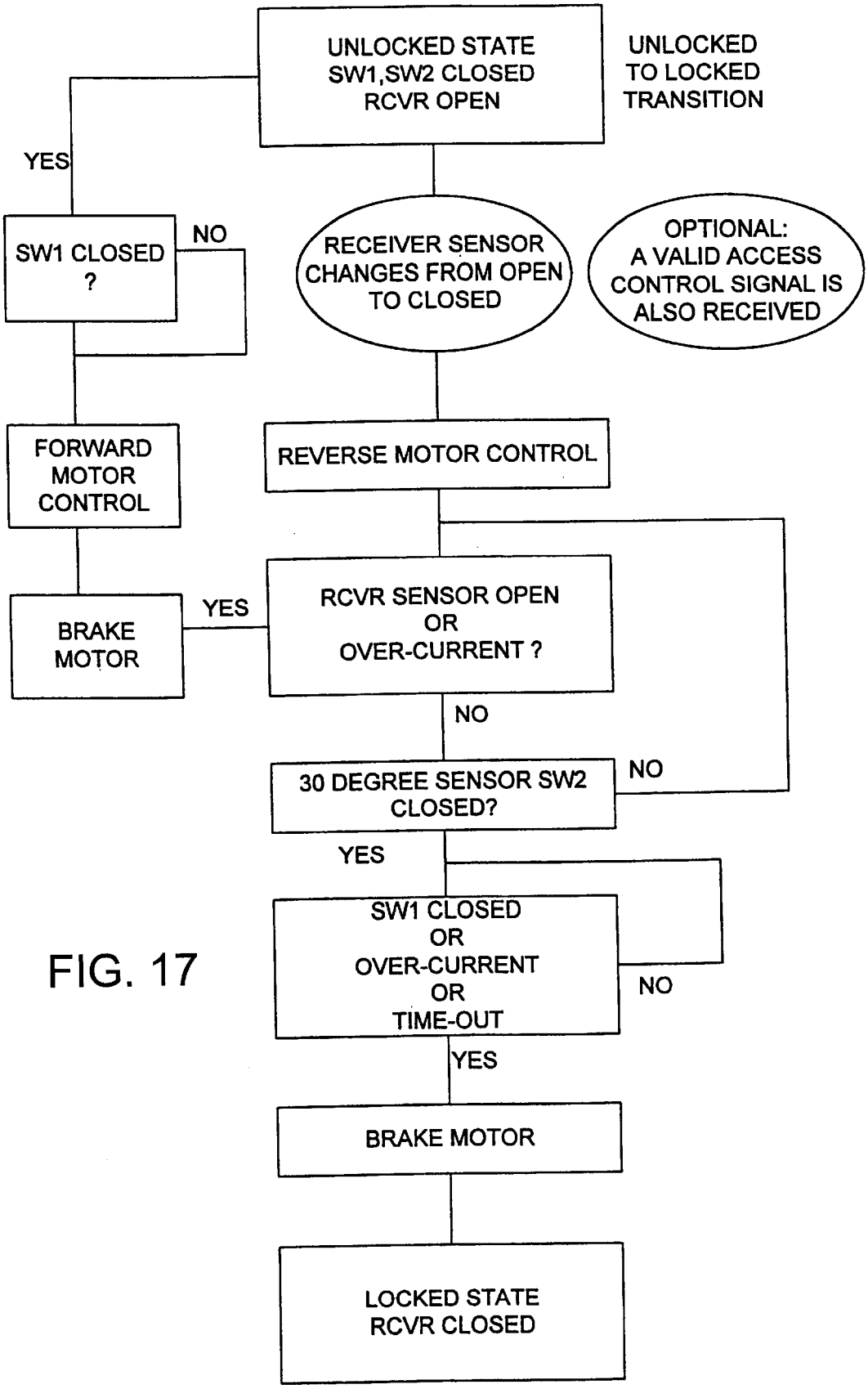

Flow-charts FIG. 16 and FIG. 17, respectively, indicate the lock to unlocked events and vise versa.

In accordance with another feature of the invention, referring to FIG. 3, an axially rotatable pin 30 with a finned end 31 is here shown on the door B. The pin 30 upon rotation when the door is closed catches one of the fins 31 against a bracket 32, here shown on the cabinet C. Placement of at least one of such pin and bracket arrangements prevents prying of the door at a corner. With the bayonet locking means adjacent an opposite corner, both door opening corners are protected.

What is claimed is:

1. A locking system for locking a movable door relative to a stationary body comprising in combination;

a bayonet locking means including a shaped end carried by either said door or stationary body;

said bayonet locking means shaped end being longitudinally translatable and rotatable;

a receiving means stationarily carried by the other of said door and stationary body adapted to receive the shaped end of said bayonet locking means;

an actuating means for advancing and retracting said bayonet locking means toward and away from said receiving means and rotating the shaped end of the bayonet locking means to capture it within and release it from the receiving means; and said actuating means including a drive means longitudinally retracting the bayonet locking means shaped end to draw the bayonet locking means together with the receiving means and longitudinally advancing to release the bayonet locking means from the stationary receiving means.

2. A locking system as claimed in claim 1 wherein at least one of said moveable door and stationary body carries a flexible peripheral gasket and said drawing of the bayonet locking means together with the receiving means causes said gasket to compressively seal the area between the door and body.

3. A locking system as claimed in claim 1 wherein said bayonet locking means and said actuating means are carried with the door.

4. A locking system as claimed in claim 1 wherein said bayonet locking means is motor driven and said actuating means has a ramped housing cooperating with a slotted housing and pin follower carried by the bayonet locking means for providing the rotational and translational movements of the shaped end of the bayonet lock.

5. A locking system as claimed in claim 1, including:

a position sensing means for sensing the longitudinal position of said bayonet means relative to said receiving means; and controlling means connected to said actuating means and said position sensing means for controlling the actuation of rotation of said shaped end of bayonet to capture it within and release it from said receiving means.

6. A locking system as claimed in claim 1, including:

a position sensing means for sensing the rotational position of said bayonet means; and controlling means connected to said actuating means and said rotation position sensing means for controlling the actuation of said shaped end of bayonet to capture it within and release it from said receiving means.

7. A locking system as claimed in claim 6, wherein said controlling means is connected to an actuator current sensing means for controlling the actuation of said shaped end of bayonet to capture it within and release it from said receiving means.

8. A locking system for locking a movable door relative to a stationary body comprising in combination;

a bayonet locking means including a shaped end carried by one of said door and stationary body;

said bayonet locking means shaped end being rotatable about its translational members centerline;

a receiving means stationarily carried by the other of said door and stationary body adapted to receive the shaped end of said bayonet locking means;

an actuating means for rotating the shaped end of the bayonet locking means to capture it and release it from the receiving means;

a access control means for receiving an access control input; and a controlling means connected to said actuating means and said access control means for controlling the actuation of said shaped end of bayonet to capture it within and release it from said receiving means.

9. A locking system as claimed in claim 8, wherein said access control means is a keypad.

10. A locking system as claimed in claim 8, wherein said access control means is a remote transmitter.

11. A locking system as claimed in claim 8, wherein said access control means is a remote transceiver.

12. A locking system as claimed in claim 8, including first sensing means for determining the relative position of said shaped end within the receiving means and second sensing means for monitoring actuation of said controlling means.

13. A locking system for locking a movable door relative to a stationary body comprising in combination;

a bayonet locking means including a shaped end carried by either said door or stationary body;

said bayonet locking means shaped end being longitudinally translatable and rotatable;

a receiving means stationarily carried by the other of said door and stationary body adapted to receive the shaped end of said bayonet locking means;

an actuating means for advancing and retracting said bayonet locking means toward and away from said receiving means and rotating the shaped end of the bayonet locking means to capture it within and release it from the receiving means;

said actuating means including a drive means longitudinally retracting the bayonet locking means shaped end to draw the bayonet locking means together with the receiving means and longitudinally advancing to release the bayonet locking means from the stationary receiving means;

and wherein one of said door and body further includes at least one rotatable pin having a finned end and the other of said door and body has a capture bracket adapted to captively hold and release said pin finned end upon rotation of the pin.

14. A locking system for locking a movable door relative to a stationary body comprising in combination;

a bayonet locking means including a shaped end carried by one of said door and stationary body;

said bayonet locking means shaped end being rotatable about its translational members centerline;

a receiving means stationarily carried by the other of said door and stationary body adapted to receive the shaped end of said bayonet locking means;

an actuating means for rotating the shaped end of the bayonet locking means to capture it and release it from the receiving means;

a current sensing means for sensing the current of said actuator; and a controlling means connected to said actuating means and said current sensing means for controlling the actuation of said shaped end of bayonet to capture it within and release it from said receiving means.

15. A locking system for locking a movable door relative to a stationary body comprising in combination;

a bayonet locking means including a shaped end carried by one of said door and stationary body;

said bayonet locking means shaped end being rotatable about its translational members centerline;

a receiving means stationery carried by the other of said door and stationary body adapted to receive the shaped end of said bayonet locking means;

an actuating means for rotating the shaped end of the bayonet locking means to capture it and release it from the receiving means;

a position sensing means for sensing the longitudinal position of said bayonet means relative to said receiving means;

an access control means for receiving an access control input; and a controlling means connected to said actuating means and said access control means and said position sensing means for controlling the actuation of said shaped end of bayonet to capture it within and release it from said receiving means.

16. A method of locking a movable door relative to a stationary body comprising in combination;

providing a bayonet locking means including a shaped end carried by one of said door and stationary body;

providing a receiving means stationarily carried by the other of said door and stationary body adapted to receive the shaped end of said bayonet locking means;

providing an actuating means for rotating the shaped end of the bayonet locking means to capture it and release it from the receiving means;

rotatably driving said bayonet locking means shaped end about its translational members centerline when positioned within the receiving means;

providing an access control means for receiving an access control input; and connecting a controlling means to said actuating means and said access control means for controlling the actuation of said shaped end of said bayonet to capture it within and release it from said receiving means.

17. A method of locking a movable door relative to a stationary body as claimed in claim 16 including sensing the longitudinal position of the bayonet means relative to the receiving means and connecting said controlling means to said position sensing means for controlling the rotational actuation of said bayonet locking means.

18. A method as claimed in claim 17 including providing a longitudinal drive means for said bayonet means interconnected to said actuating means for rotatably and longitudinally operating said bayonet means in a predetermined sequence for capture and release from said receiving means.

* * * * *